United States Patent [19]

Walchek

[11] 3,945,787

[45] Mar. 23, 1976

[54] CAP REST ASSEMBLY FOR PACKERHEAD/VIBRATION SYSTEM CONCRETE PIPE MACHINE

[75] Inventor: Ronald J. Walchek, South Sioux City, Nebr.

[73] Assignee: Concrete Pipe Machinery Company, Sioux City, Iowa

[22] Filed: Apr. 19, 1973

[21] Appl. No.: 352,672

[52] U.S. Cl. ..... 425/262; 249/100; 425/412

[51] Int. Cl.[2] ..... B28B 21/26

[58] Field of Search..... 249/100; 425/262, 426–428, 425/431, 457, 460, 468–469, 421, 432, 456, 416, 431; 264/71–72, 312; 16/147; 292/216

[56] References Cited

UNITED STATES PATENTS

| | | | |
|---|---|---|---|
| 1,707,682 | 4/1929 | Parsons | 292/216 |
| 1,938,230 | 12/1933 | Ukropina | 425/262 |
| 3,114,956 | 12/1963 | Gannaway | 249/100 |
| 3,179,998 | 4/1965 | Lamb | 425/448 |
| 3,201,843 | 8/1965 | Osweiler | 425/421 |
| 3,276,091 | 10/1966 | Pausch | 249/100 |
| 3,539,802 | 11/1970 | Garnett et al. | 16/147 |
| 3,752,626 | 8/1973 | Trautner et al. | 425/262 |

FOREIGN PATENTS OR APPLICATIONS

| | | | |
|---|---|---|---|
| 830,285 | 3/1960 | United Kingdom | 249/202 |

*Primary Examiner*—Francis S. Husar
*Assistant Examiner*—John McQuade
*Attorney, Agent, or Firm*—Strauch, Nolan, Neale, Nies & Kurz

[57] ABSTRACT

A cap rest assembly to support a closed bore cap slightly above the upper periphery of the pipe jacket in a packerhead/vibration system concrete pipe machine, which has a slump filler attachment enabling making of a green pipe including the upper end in a continuous operation by overfilling the jacket slightly, the cap rest assembly supporting and enabling automatic release of the closed bore cap when the slump filler compression ring depresses the closed bore cap and overfills concrete into the top end of the pipe jacket to complete the green pipe.

18 Claims, 10 Drawing Figures

CAP REST ASSEMBLY FOR PACKERHEAD/VIBRATION SYSTEM CONCRETE PIPE MACHINE

CROSS REFERENCE TO RELATED APPLICATION

The slump filler of a packerhead/vibration system concrete pipe machine with which this invention is particularly useful is disclosed and claimed in a copending application entitled SLUMP FILLING APPARATUS AND METHOD IN CONCRETE PIPE MANUFACTURE, Ser. No. 345,743, filed Mar. 28, 1973, and assigned to the same assignee as this application (hereinafter "slump filler application").

BACKGROUND OF THE INVENTION

The above referenced copending application discloses a slump filling apparatus for a packerhead/vibration system concrete pipe machine, the slump filler having an overfill and compaction ring assembly mounted on the top of the pipe mold or jacket which enables complete formation of the concrete pipe in single stage fashion without necessity of adding extra concrete to the top of the jacket to make up for volume lost in compaction of the material caused by vibration. The slump filler is useful with any one of a wide variety of available concrete pipe machines, and basically includes an overfill and compression ring assembly surmounting the pipe jacket which has a downwardly driven compression ring to compress overfill concrete into the top of the pipe jacket during the final stages of manufacture of a green pipe to complete the top of spigot end of the pipe, both the vibration and the compression ring causing the overfill to compact into the pipe jacket.

In the type of concrete pipe machines being discussed, a vertically disposed pipe jacket is used as a form for the pipe to be made, having a lower bell forming end and an upper spigot forming end. Interiorally of the upper periphery of the pipe jacket is a cap which completes the formation of the pipe spigot end. Such caps are of two varieties: "open" and "closed". An "open" bore cap covers only about one-half of the outer periphery of the spigot end of the pipe, the remaining half being formed by the compression ring of the slump filler, which acts directly on overfill concrete concentrically interiorally of the open bore cap, the open bore cap remaining stationary during operation of the slump filler, as shown in FIGS. 6 and 7 of the slump filler application.

Conversely, a "closed" bore cap covers and forms substantially the entire outer periphery of the spigot end of the pipe. Thus, when the slump filler is used with closed bore caps, the entire cap must be moved from an elevated, overfill accomodation position, to a lower, spigot end forming disposition, the compression ring of the slump filler acting directly on the closed bore cap to compress overfill concrete into the pipe jacket, since there is no room for the compression ring to act directly on the overfill concrete.

Thus, when utilizing a closed bore cap, a support assembly is required to retain the closed bore cap in an elevated position as the pipe is formed and the support for the closed bore cap must be releasable during actuation of the slump filler so that the closed bore cap may move downwardly into the top end of the pipe jacket to complete the pipe spigot end. To accomplish the foregoing operation one initial attempt utilized a hydraulically actuated cap support assembly which was found to be not entirely satisfactory. The presently disclosed and claimed cap rest assembly evolved from the earlier attempt.

SUMMARY OF THE INVENTION

It is a primary object of this invention to provide a cap rest assembly for the closed bore cap for a pipe jacket in a packerhead/vibration system concrete pipe machine having a slump filler thereon, to support the closed bore cap in an elevated attitude to accommodate overfill concrete therebeneath and enabling automatic release of the closed bore cap upon actuation of the slump filler.

It is another object of the invention to provide a cap rest assembly for the closed bore cap of the pipe jacket of a packerhead/viibration system concrete pipe machine employing a slump filler which is entirely mechanical in structure and function.

Yet another object of the invention is to provide a cap rest assembly for the closed bore cap of the pipe jacket of a slump filler equipped packerhead/vibration concrete pipe machine which is adjustable to support a wide variety of weights and sizes of closed bore caps.

It is still another object of the invention to provide a cap rest assembly supporting the closed bore cap of the pipe jacket of a slump filler equipped packerhead/vibration concrete pipe machine and having a positive lock to secure the cap rest in its non-supporting attitude.

A further object of the invention is to provide a cap rest assembly for the closed bore cap of the pipe jacket of a packerhead/vibration system concrete pipe machine which automatically releases the closed bore cap upon actuation of the slump filler, without need of any additional actuating mechanism or control by the concrete pipe machine operator.

Further novel features and other objects of this invention will become apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings in which.

DESCRIPTION OF THE PREFERRED EMBODIMENTS

Figure 1:
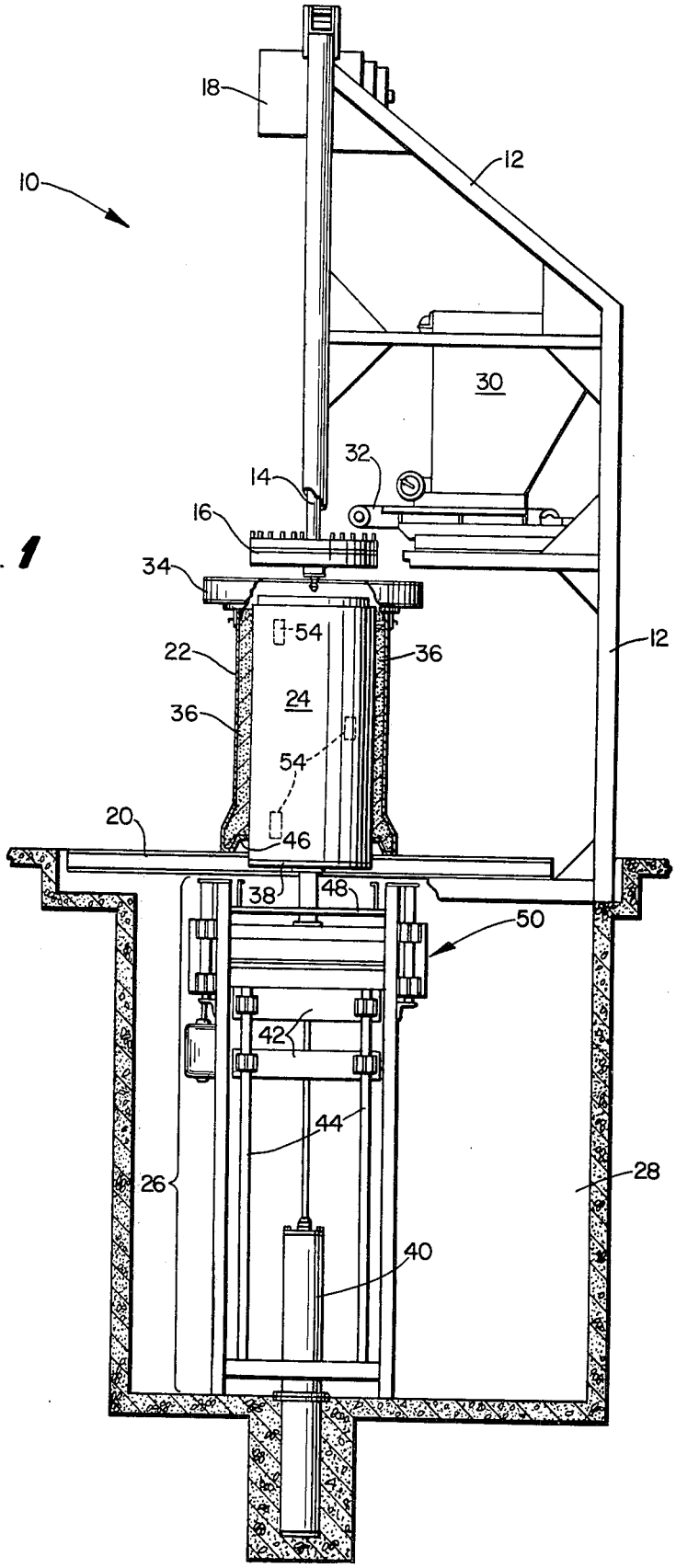
FIG. 1 is a side elevation view of a commercial embodiment of a packerhead/vibration system concrete pipe machine showing a machine employing a rollerhead, the view being partly in section with parts broken away to show interior detail and illustrates the environment of structure utilizing the present invention.
Figure 3:
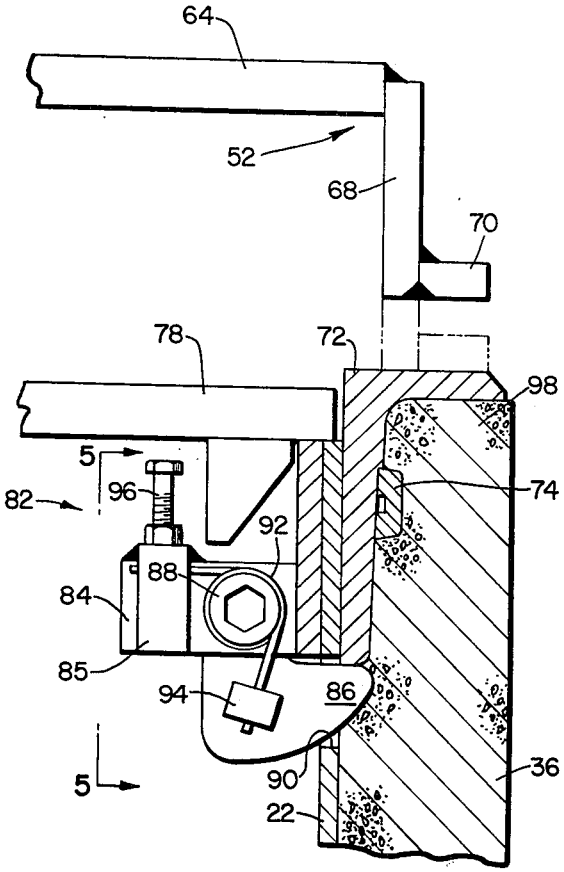
FIG. 3 is a greatly enlarged detail, partial section view of the upper left hand portion of FIG. 2, showing the cap rest assembly supporting a closed bore cap prior to actuation of the slump filler.

FIG. 1 of this application conforms to FIG. 3 of the above identified slump filler application and shows a "McCracken" packerhead machine employing a "Viropac" supplemental vibration system, both being made and sold by the assignee of this application.

The pipe machine 10 has a frame superstructure 12, a packershaft 14 having a rollerhead type of packerhead 16 depending from crosshead 18 which is guided for vertical movement on guide tubes (not shown) in superstructure 12, a turntable 20 for rotating a pipe mold or jacket 22 into and out of a pipe forming position, a "Viropac" core 24, and a "Viropac" unit 26, located in a pit 28 beneath turntable 20. A concrete material boot 30 and material conveyor 32 supply the cementitious material through hopper 34 on top of jacket 22 to make a green pipe 36.

The "Viropac" non-rotating core 24 is mounted beneath turntable 20 on a core support platform 38 which is raised and lowered by a hydraulic piston-cylinder actuator 40. The platform 38 is guided for vertical movement by a plurality of bearing block assemblies 42 movable along a corresponding plurality of stationary guide rods 44 (four of each, in this example). Pipe jacket 22, which may be either a single or multiple piece unit, has a bell end forming section at its lower end and a spigot end forming section at the top. A bell end pallet 46 is located concentrically interiorally at the base of jacket 22. A turning and vibrating standard 48, is raised by a bell down unit 50 to rotate and vibrate pallet 46 during the initial stages of forming a green pipe 36. At such time, the turning and vibrating motion imparted to pallet 46 assures vibration which enables desired densification of the material forming the bell end of the green pipe 36.

Figure 2:
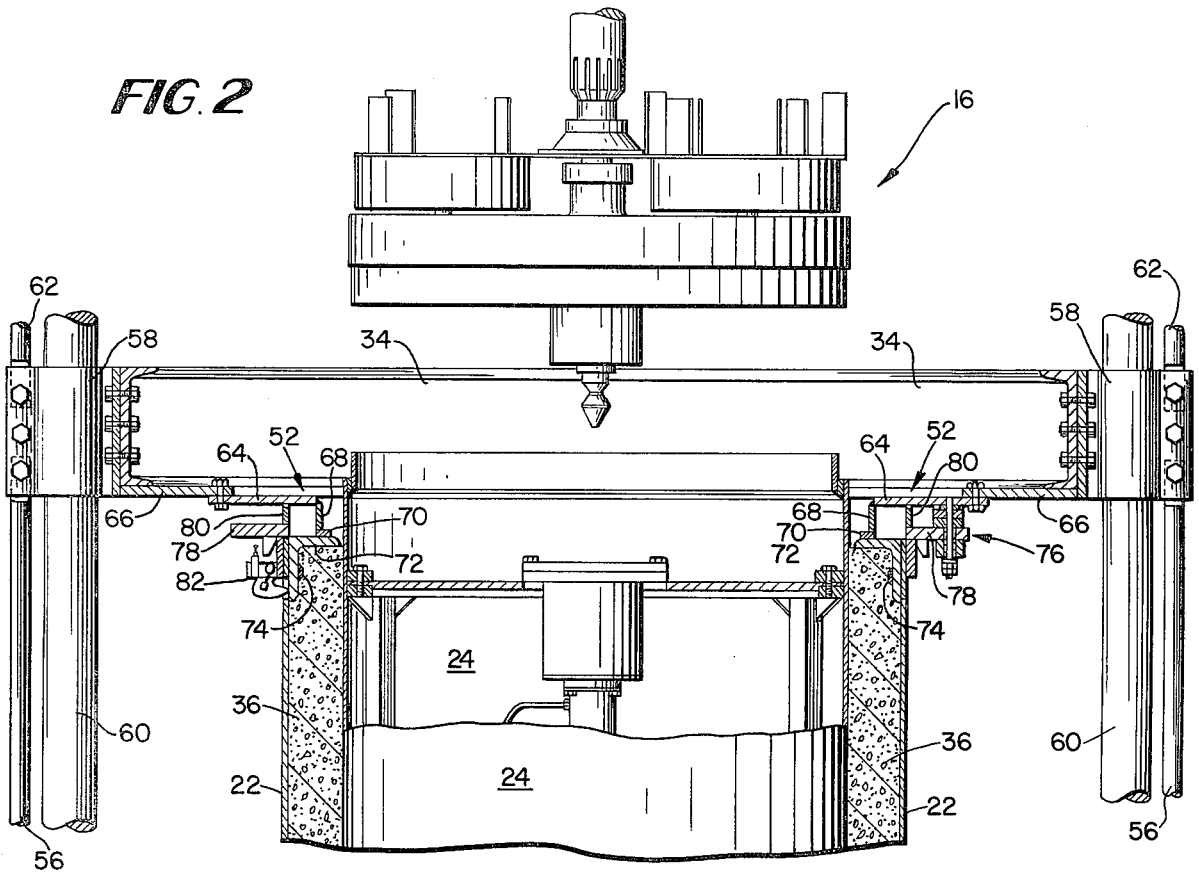
FIG. 2 is an enlarged scale front elevation view taken from the center of FIG. 1, showing the relationship of vibrating core, hopper and rollerhead just after completion of a compression operation by the slump filler as used with a closed bore cap and cap rest assembly in accord with the present invention.

FIG. 2 illustrates a stage of manufacture wherein the green pipe 36 has been completely formed, including actuation of a slump filler 52 which permits slight overfill of pipe jacket 22 followed by compression of the overfill material and vibration of "Viropac" core 24, as by one or more vibrators 54 (FIG. 1), to consolidate and form the spigot end of the pipe, all in one continuous operation without need of adding extra material to jacket 22 to compensate for material volume lost by vibration/consolidation. A complete explanation of the operation of slump filler 52 will be found in the slump filler application. During all steps of forming green pipe 36, hopper 34 serves also to clamp pipe jacket 22 to turntable 20 by reason of a pair of hopper holddown cylinders 56 bolted to the outer ends of hopper bearing blocks 58 which, in conjunction with hopper guide tubes 60, guide hopper 34 for vertical movement. After a pipe making operation, hopper 34 is lifted from jacket 22 by a pair of lift rods 62, slidably connected to the struts of crosshead 18 (not shown) so that turntable 20 may be rotated to bring an empty jacket 22 into position for another pipe making operation.

The slump filler 52 includes a filler ring 64, bolted to hopper bottom plate 66, a spacer ring 68, welded to the inner peripheral edge of filler ring 64, and a compression ring 70 for bearing against a closed bore cap 72, which has a snap ring 74 therein for forming a seal ring groove in the spigot end of the pipe. Prior to its actuation, in the pipe making process, slump filler 52 is separated from the upper periphery of jacket 22 by a series (three in this case) of hydraulic ram actuators 76 circumferentially spaced around top centering ring 78. Each actuator includes slip posts connecting top centering ring 78 and filler ring 64 these posts further determining maximum axial separation of top centering ring 78 with respect to filler ring 64. Conversely, minimum axial separation between these rings after actuation of slump filler 52 is determined by a spacer ring 80, welded to the inner peripheral edge of top centering ring 78.

Actuation of slump filler 52 occurs by cooperation of ram actuators 76 and hopper holddown cylinders 56. That is, ram actuators 76 are fully extended to axially separate slump filler 52 and top centering ring 78, against the downward force of holddown cylinders 56 acting on blocks 58, hopper 34 and consequently slump filler 52. During the step of compaction of the spigot end of green pipe 36, pressure in ram actuators 76 is relieved so that slump filler 52, with its compression ring 70, moves downwardly towards top centering ring 78, to the position illustrated in FIG. 2.

As set forth in the slump filler application, when the Slump Filler is used with open bore caps, which form only about one-half of the outer peripheral surface of the spigot end of a green pipe the slump filler compression ring acts directly against overfill material, fitting neatly peripherally inwardly of the open bore cap, while the open bore cap remains in a stationary position on the top inner surface of its pipe jacket.

However, when slump filler 52 is used with closed bore caps such as 72, then the closed bore cap itself must be moved from an elevated, overfill material accommodation position (FIG. 3) to a lower, spigot end forming position (FIG. 4) because there is no room for compression ring 70 to fit between closed bore cap 72 and the vibrating core 24 (FIG. 2) which is in the disposition shown in FIG. 2 to vibrate material during the operation of slump filler 52. Therefore, it is necessary to provide retractable closed bore cap rest means which will support the closed bore cap in an elevated position during formation of the main body of a green pipe, but which will automatically retract to a non-supporting position to allow the closed bore cap to be depressed by the slump filler 52 to complete formation of the spigot end of the green pipe.

One embodiment of an acceptable closed bore cap rest assembly is disclosed in FIG. 2 and 3–5. The assembly includes a plurality (three in this example) of circumferentially spaced cap rests 82, each having a plural lug mounting structure 84 welded to jacket 22 near the upper, outer peripheral edge thereof, an inverted U-shaped spring anchor bracket 85 welded to lugs 84 and a cap rest foot 86 pivotally dependant from lugs 84 and secured by a retainer bolt 88 through lugs 84. Cap rest foot 86 is urged to a support disposition with its toe projecting interiorally of pipe jacket 22 through an associated aperture 90, preferably a slotted opening therein, beneath closed bore cap 72 (FIG.3), by a pair of coil wound torsion springs 92 located on retainer bolt 88, or on sleeves slipped over the bolt. The torsion springs are disposed on opposite sides of lugs 84. Lateral spring anchor blocks 94 secured to opposite sides of the rest foot 86 serve to anchor one end of the torsion springs 92 while the opposite ends of springs 92 are retained under U-bracket 85 and about individual set screws 96 which may be adjusted to select a desired torsional biasing force of springs 92. Accordingly, cap rests 82 are adaptable for use with a wide variety of closed bore caps of varying size and weight.

Figure 4:
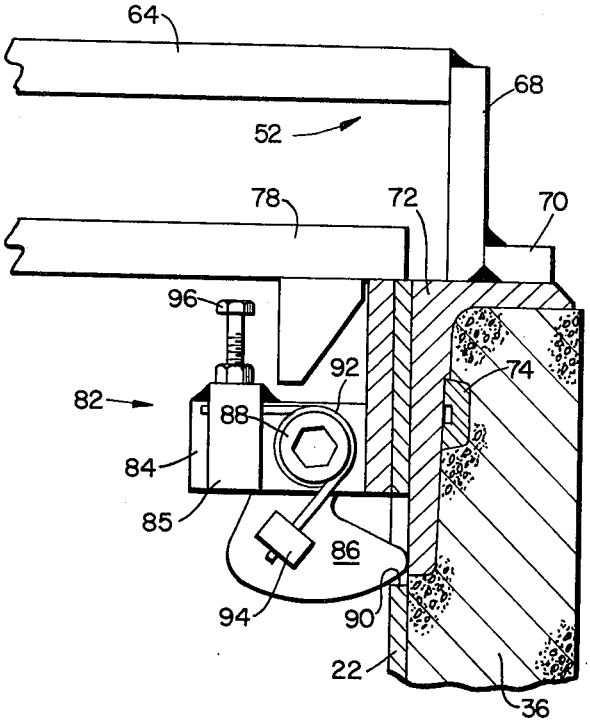
FIG. 4 is a view similar to FIG. 3, but showing relationship of parts after actuation of the slump filler, the cap rest being in a non-supporting position.

When slump filler 52 is actuated, compression ring 70 forces closed bore cap 72 downwardly to compress the cementitious overfill material 98 (FIG.3) into pipe jacket 22 to complete formation of the spigot end of green pipe 36 (FIG. 4). Simultaneously, all of the circumferential spaced cap rest feet 86 will be forced outwardly of the pipe jacket 22 to their non supporting position shown in FIG. 4, by the closed bore cap which is being forced down into the jacket, there being sufficient force exerted by holddown cylinders on closed bore cap 56 (FIG. 2) to overcome the biasing force exerted on the cap rest feet by torsion springs 92.

Figure 7:
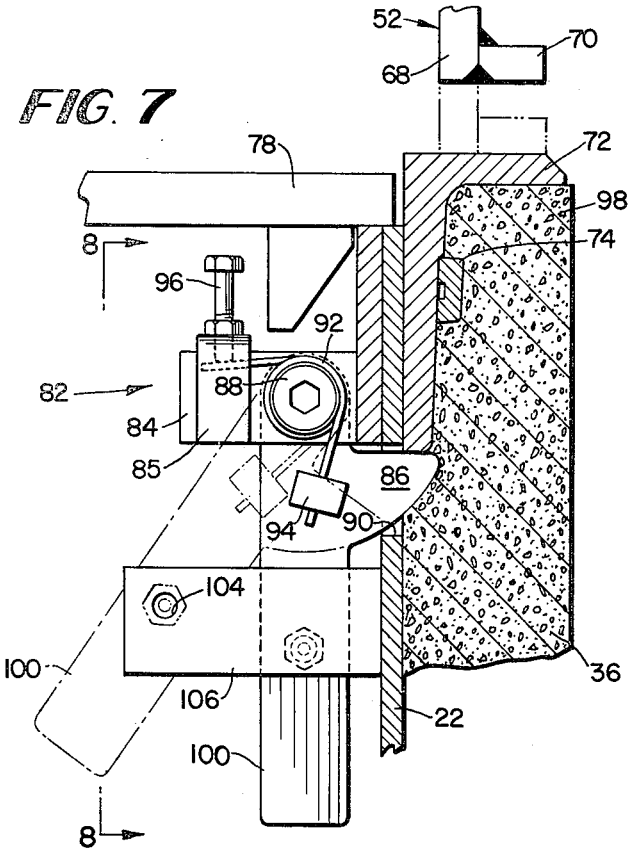
FIG. 7 is a view similar to FIG. 3 but showing another emobidment of the invention.
Figure 8:
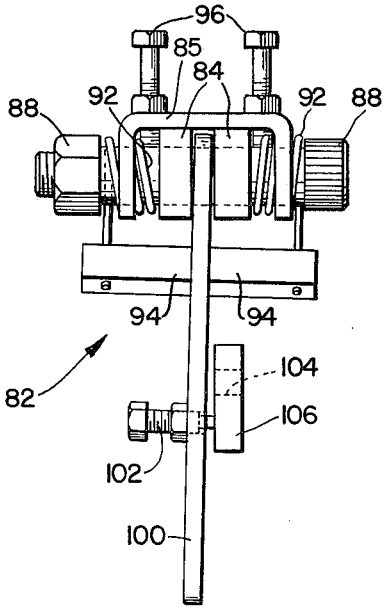
FIG. 8 is a section view of the embodiment of the invention shown in FIG. 7, taken along lines 8—8 of FIG. 7.

Another embodiment of a cap rest assembly is shown in FIGS. 7 and 8, which is particularly useful with single piece pipe jackets 22. Single one piece pipe jackets have a single vertical seam throughout their length with a lock to open the seam slightly when the jacket is to be removed from a completed green pipe. Thereafter, the jacket is removed from the green pipe by an overhead stripper, the jacket being lifted, vertically, off of the green pipe.

Figure 5:
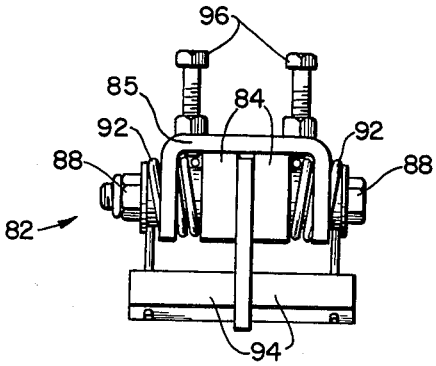
FIG. 5 is a section view of one cap rest member, taken along lines 5—5 of FIG. 3.

If the cap rest embodiment shown in FIG. 3-5 were to be used with one piece pipe jackets, the cap rest foot 86 of each cap rest 82 would bear against the closed bore cap 72 (FIG. 4) during stripping, thereby probably causing the cap 72 to be dislodged which would result in cracking the green pipe spigot end. Thus, the green pipe would be useless and would be discarded. (In the case of multipiece pipe jackets, there is no such problem.)

Accordingly, in this second embodiment, each cap rest 82 is provided with a depending handle 100 having a dog 102 arranged to engage a bore 104 in a flat 106 welded to jacket 22 when the cap rest 82 is in a non cap supportive position. Thus, after complete formation of green pipe 36 and prior to stripping of the pipe jacket, handle 100 is moved outwardly so that dog 102 engages bore 104 so that cap rest foot 86 does not abut against closed bore cap 72, as shown by phantom lines in FIG. 7. Thereafter, the pipe jacket may be stripped from the green pipe without fear of dislodging closed bore cap 72 and destroying the pipe.

The adaptability of the invention to any one of a wide variety of pipe making situations is illustrated by the following example.

Figure 6:
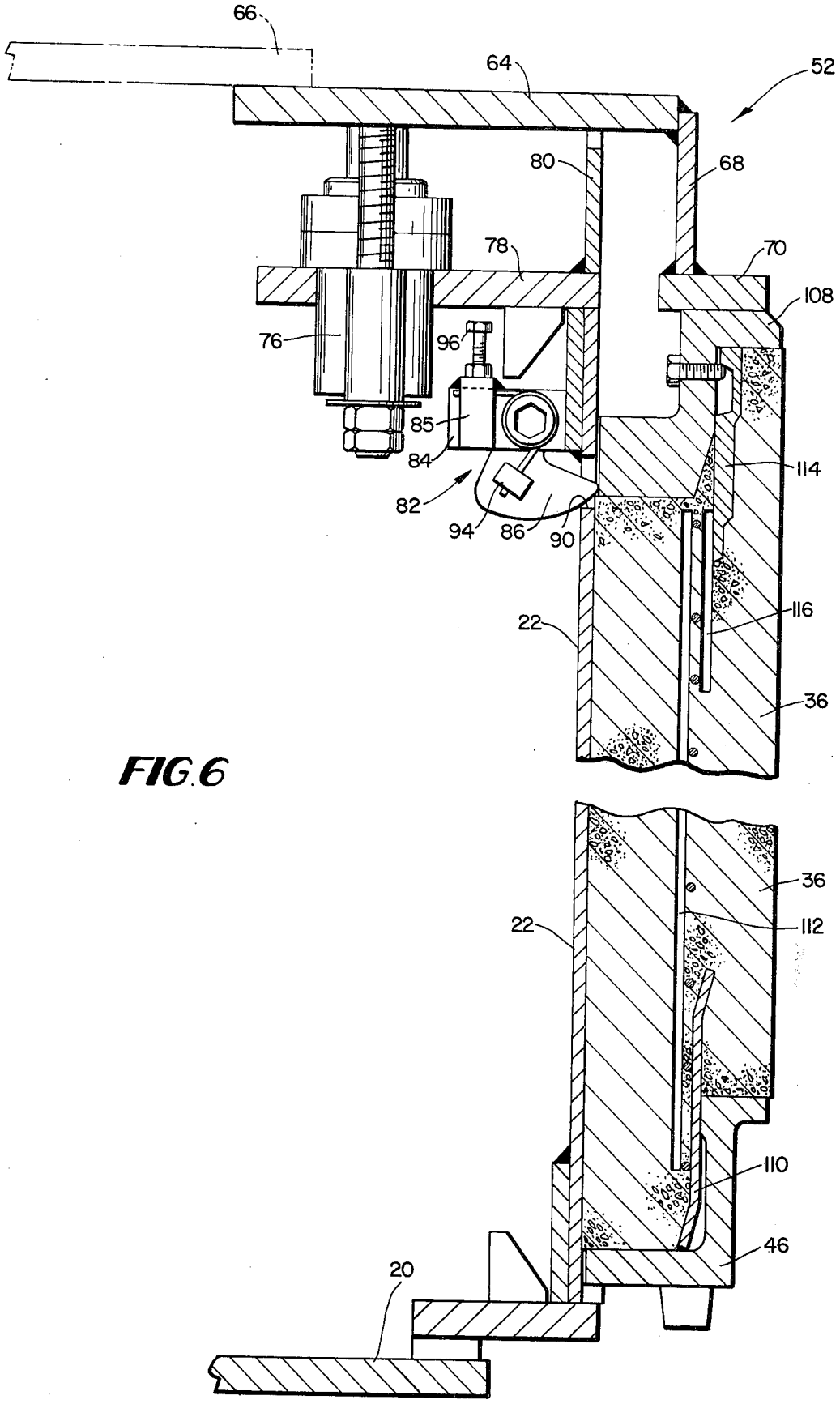
FIG. 6 is an enlarged partial detail section view showing the left hand portion of a cap rest member and the slump filler being used in the manufacture of steel end ring, non-cylinder concrete pipe, non-prestressed.

The embodiment of the invention shown in FIG. 3–5 is illustrated in FIG. 6, with slump filler 52, in making green pipe 36 which is reinforced and employs a Z-closed bore cap 108 to form the spigot end of green pipe 36. Specifically, green pipe 36 in this instance is a section of steel end ring non-cylinder concrete pipe, non-prestressed, which is used in the water supply industry for low-head transmission lines (See American Water Works Association Manual M9, New York, 1961: pp. 4–5). The reinforcement shown includes a lower bell ring 110 welded to lower, wire cage reinforcement 112, and an upper spigot ring 114 welded to upper wire cage reinforcement 116. Sections 110–112 and 114–116 are situated in telescoping relationship, unconnected one to the other, so that Z-closed bore cap 108 may be moved downwardly by slump filler 52 against the urging of cap rests 82.

Figure 9:
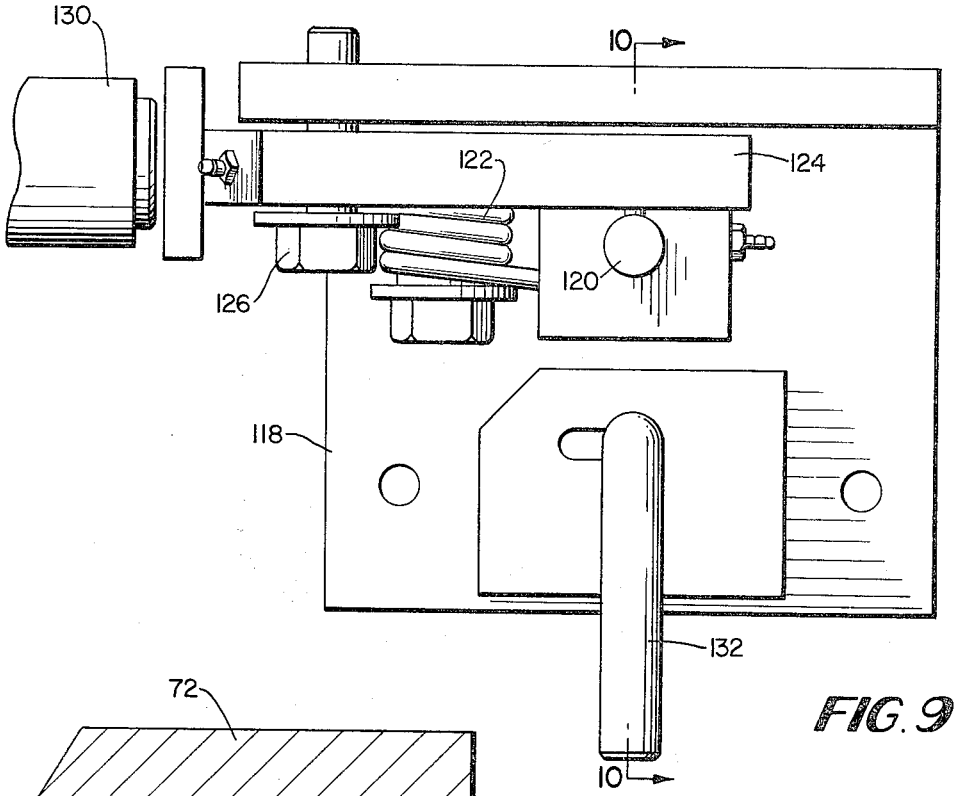
FIG. 9 is a greatly enlarged elevation view of an earlier development of cap rest assembly.
Figure 10:
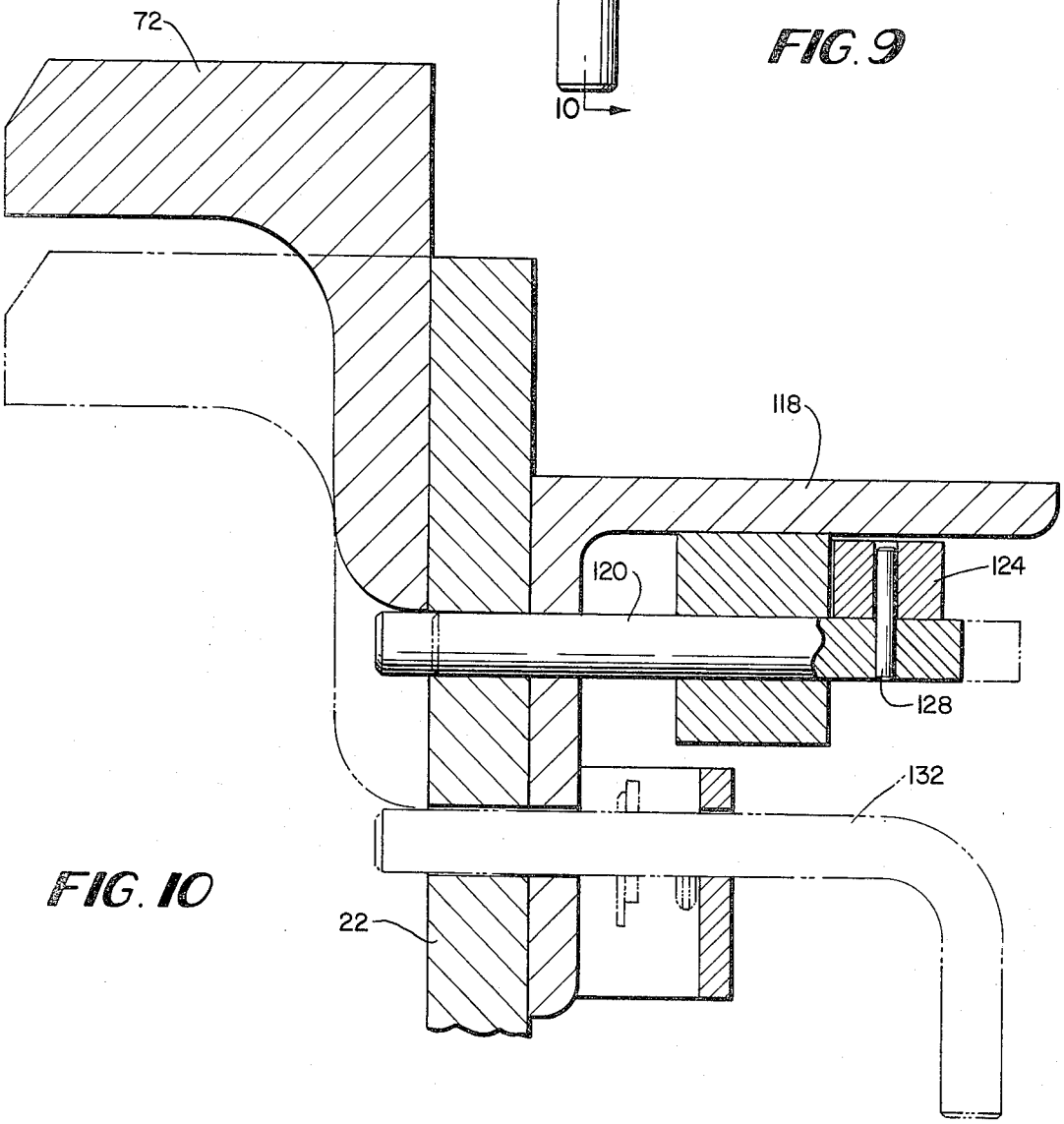
FIG. 10 is a partial section view taken along lines 10—10 of FIG. 9.

An earlier developement of a cap rest assembly is disclosed in FIG. 9 and 10. A mounting bracket 118 has a cap support pin 120 slidably mounted therein, biased to a closed bore cap supportive disposition (shown in solid lines, FIG. 10) by a torsion spring 122 bearing against one leg of a lever 124 having its fulcrum at bolt 126. The other leg of lever 124 is connected to support pin 120 by a pin 128. A hydraulic actuator 130 is secured beneath top centering ring 78 (not shown in FIG. 9 and 10) and serves to retract support pin 120 to the position shown in FIG. 10 by phantom lines, upon actuation of the slump filler (not shown). An open bore cap support pin 132 is provided when open bore caps are used, but are removed when closed bore caps are used.

Although the closed bore cap rest assembly shown in FIGS. 9 and 10 will operate satisfactorily under suitable conditions, it is more expensive to produce, requiring a hydraulic actuator 130, and the timing of its operation is difficult to maintain under repeated use, in that support pins 120 must be retracted immediately upon actuation of the slump filler; otherwise they will be bent or even broken. On the contrary, the cap rest assembly of the present invention retracts automatically without need of separate controls, and is far less expensive to produce and maintain over a period of time, since it is entirely mechanical in structure and actuation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In vertically disposed pipe mold means comprising core means, cap means forming the upper end of a green pipe interiorally of said pipe mold means and means for moving said cap means downwardly with respect to said pipe mold means; releasable cap support means for supporting said cap means, said cap support means including releasing means thereon beneath said cap means for non-manually, automatically releasing support of said cap means in response to forced downward movement of said cap means against said cap support means, said releasing means and said cap support means being forced to a position other than beneath said cap means to thereby release support of said cap means by said releasable cap support means.

2. The releasable cap support means as recited in claim 1 wherein said releasing means further comprise means for pivotally mounting said releasing means about horizontal axes, said horizontal axes being generally tangential to said pipe mold means.

3. A packerhead/vibration system for making cementitious material pipe, comprising: vertical pipe mold means; vibratable core means movable upwardly through said pipe mold means; packerhead means above said core means and movable therewith as cementitious material is introduced into said core means to form the major portion of a pipe; overfill cementitious material accommodation means on said pipe mold means comprising closed bore cap means for forming substantially the entire outer peripheral end of a green pipe; means, surmounting said vertical pipe mold means, for moving said bore cap means downwardly with respect to said pipe mold means; and cap rest assembly means including means for supporting said cap means on said pipe mold means in an elevated attitude with respect to said pipe mold means during formation of the major portion of a pipe, said cap rest assembly means further including means for non-manually, automatically releasing said cap means in response to downward movement of said cap means against said cap supporting means.

4. The packerhead/vibration system as recited in claim 3 wherein said cap rest assembly means comprise at least three releasable cap rest support means circumferentially spaced about the upper periphery of said pipe mold means.

5. The packerhead/vibration system as recited in claim 4 wherein each of said releasable cap rest support means comprise a support foot, pivotally mounted on a horizontal axis exteriorally of said pipe mold means, means defining an opening through said pipe mold means, at least a portion of said support foot adapted in a support condition to project through said opening to a position interiorally of said pipe mold means beneath and in supporting relationship beneath said cap means, said support foot being forced outwardly of said pipe mold means to a non-supporting disposition upon downward movement of said cap means.

6. The packerhead/vibration system as recited in claim 5 wherein said each of said cap rest support means further comprise means for biasing said support foot towards said pipe mold means beneath said cap means, about said horizontal axis.

7. The packerhead/vibration system as recited in claim 6 wherein said biasing means comprise torsion spring means.

8. The packerhead/vibration system as recited in claim 7 wherein said torsion spring means further comprise means for selectively adjusting the biasing force of said torsion spring means.

9. The packerhead/vibration system as recited in claim 5 wherein each said cap rest support means further comprise means for securing said support foot in a non-supporting disposition substantially outwardly of the interior of said pipe mold means.

10. The packerhead/vibration system as recited in claim 9 wherein said securing means comprise a handle, depending downwardly from said supportive foot, exteriorally of said pipe mold means, and a latch member, mounted on said pipe mold means, for securing said handle with said foot in said non supporting disposition.

11. In a packerhead/vibration system for making cementitious material pipe comprising vertical pipe mold means, vibratable core means movable upwardly through said pipe mold means, packerhead means above said core means and movable therewith as cementitious material is introduced into said core means to form the major portion of a pipe, closed bore cap means adjacent the upper periphery of said pipe mold means for forming substantially the end of a green pipe, and means for moving said cap means downwardly with respect to said pipe mold means; cap rest assembly means including means for supporting said cap means on said pipe mold means in an elevated attitude with respect to said pipe mold means said cap rest assembly means further including means for non-manually, automatically releasing said cap means in response to forced downward movement of said cap means against said cap supporting means.

12. The cap rest assembly means as recited in claim 11 wherein said assembly means comprise a plurality of releasable cap rest support means, circumferentially spaced about the outer upper periphery of said pipe mold means.

13. The cap rest assembly means as recited in claim 12 wherein each of said cap rest support means comprise a support foot, means pivotally mounting said foot about a horizontal axis exteriorally of said pipe mold means, and means biasing said foot so at least a portion thereof is disposed interiorally of said pipe mold means, beneath said cap means.

14. The cap rest assembly means as recited in claim 13 wherein said biasing means comprise spring means on said pivotal mounting means.

15. The cap rest assembly means as recited in claim 14 wherein said biasing means further comprise means for adjustably preselecting the biasing force of said spring means against said foot.

16. The cap rest assembly means as recited in claim 13 wherein said support foot inclues means for securing said foot in an non-supporting disposition substantially exteriorally of said pipe mold means.

17. The cap rest assembly means as recited in claim 16 wherein said securing means comprise a handle depending downwardly from said supportive foot and latch means securing said handle and foot in said non-supporting disposition.

18. In a vertically disposed pipe mold means comprising core means, cap means for forming the upper end of a green pipe interiorally of said pipe mold means and means for moving said cap means downwardly with respect to said pipe mold means; releasable cap support means for nonmanually, automatically releasing support of said cap means in response to forced downward movement of said cap means against said cap support means.

* * * * *